US006537047B2

(12) United States Patent
Walker

(10) Patent No.: US 6,537,047 B2
(45) Date of Patent: Mar. 25, 2003

(54) REVERSIBLE VARIABLE DISPLACEMENT HYDRAULIC PUMP AND MOTOR

(76) Inventor: Frank H. Walker, 8087 Hawkcrest Dr., Grand Blanc, MI (US) 48439

( * ) Notice: Subject to any disclaimer, the term of this patent is extended or adjusted under 35 U.S.C. 154(b) by 0 days.

(21) Appl. No.: 09/784,763

(22) Filed: Feb. 15, 2001

(65) Prior Publication Data

US 2001/0036411 A1 Nov. 1, 2001

Related U.S. Application Data

(60) Provisional application No. 60/182,499, filed on Feb. 15, 2000.

(51) Int. Cl.[7] ..... F03C 1/253; F04C 2/344

(52) U.S. Cl. ..... 418/147; 418/132; 418/133; 418/236; 418/259; 418/30; 417/204

(58) Field of Search ..... 418/147, 225, 418/236, 238, 259, 132, 133

(56) References Cited

U.S. PATENT DOCUMENTS

| | | | | | |
|---|---|---|---|---|---|
| 527,082 | A | * | 10/1894 | Smith | 418/238 |
| 582,696 | A | * | 5/1897 | Schneible et al. | 418/225 |
| 787,988 | A | * | 4/1905 | Moore | 418/225 |
| 793,664 | A | * | 7/1905 | Kleindienst | 418/259 |
| 865,117 | A | * | 9/1907 | Muhl | 418/225 |
| 2,195,812 | A | * | 4/1940 | Czarnecki | 418/225 |
| 5,310,326 | A | * | 5/1994 | Gui et al. | 418/236 |

FOREIGN PATENT DOCUMENTS

| | | | | |
|---|---|---|---|---|
| BE | 504857 | * | 8/1952 | 418/238 |
| DE | 2832247 | * | 1/1980 | 418/236 |
| FR | 555113 | * | 3/1923 | 418/236 |
| IT | 250218 | * | 7/1926 | 418/225 |
| IT | 262358 | * | 9/1927 | 418/225 |
| JP | 57-83689 | * | 5/1982 | 418/236 |
| SU | 531924 | * | 10/1976 | 418/236 |

* cited by examiner

*Primary Examiner*—John J. Vrablik
(74) *Attorney, Agent, or Firm*—Brooks & Kushman P.C.

(57) ABSTRACT

A compact high efficiency vane pump is disclosed having a unique T-shaped vane and rotor slot configuration with a roller tip vane in a uniquely configured chamber. To minimize friction in chamber diameter, a pressure plate is provided which is hydraulically balanced, both in the forward and reverse pump and motor modes, having micro pressure pulses which vary multiple times per rotor rotation in order to compensate for varying hydraulic axial load on the housing.

5 Claims, 9 Drawing Sheets

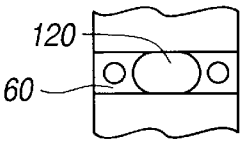
FIG. - 10
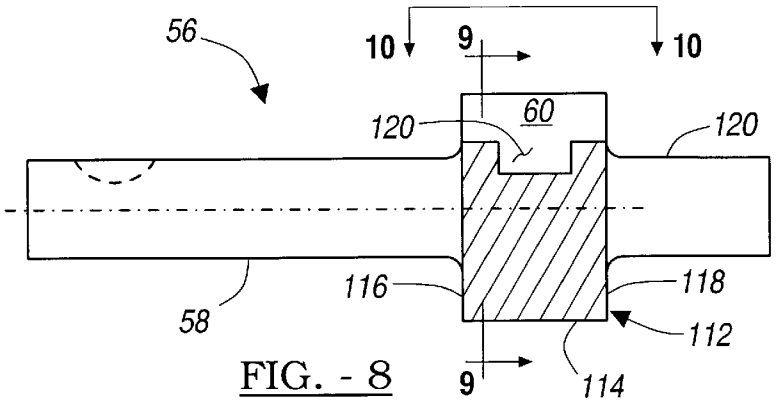
FIG. - 8
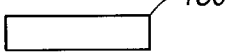
FIG. - 14
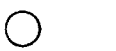
FIG. - 15
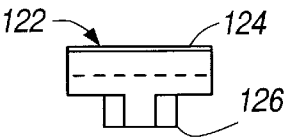
FIG. - 11
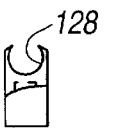
FIG. - 12
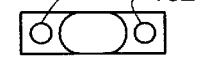
FIG. - 13
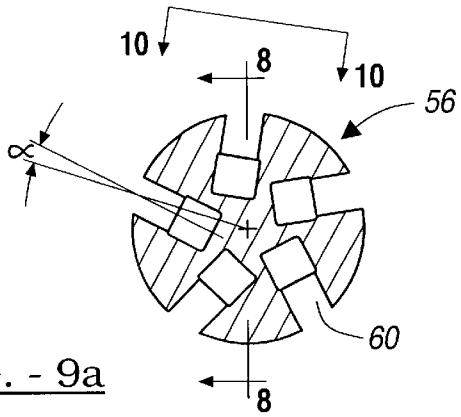
FIG. - 9a
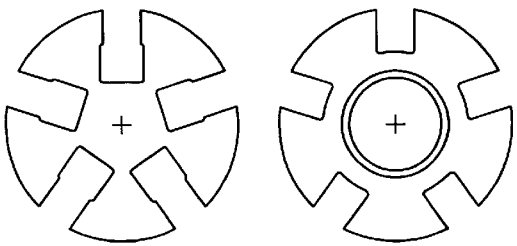
FIG. - 9b
FIG. - 9c
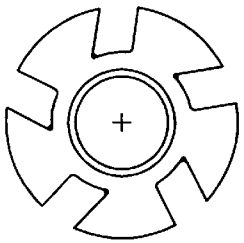
FIG. - 9d

REVERSIBLE VARIABLE DISPLACEMENT HYDRAULIC PUMP AND MOTOR

CROSS-REFERENCE TO RELATED APPLICATIONS

This application claims the benefit of U.S. provisional application Serial No. 60/182,499 filed Feb. 15, 2000.

BACKGROUND OF THE INVENTION

1. Field of the Invention

This application relates to hydraulic vane pumps and more particularly to reversible pumps which can be used in either the motor or pump mode.

2. Background Art

The key to the design of a highly efficient hydraulic pump/motor is to optimize the following characteristics:

a) low internal leakage by minimizing the size and number of moving parts, controlling clearances by using precision manufacturing processes, and adding auxiliary seals as required;

b) maintaining minimum operating axial clearances by utilizing pressure compensation to balance clamping and separating forces;

c) low mechanical friction resulting from balancing forces where possible, maximizing rotor and vane rigidity, utilizing rolling element bearings where possible to replace sliding elements, and minimizing sliding velocities which is accomplished by minimizing the size of the physical components;

d) low fluid flow restriction; and e) maximizing fluid power capacity for a given mass and package size—use of light weight materials where possible.

In addition, many applications require full adjustment of fluid displacement, and even over-center adjustment to facilitate the transition from pumping to motoring and vice versa or to accommodate reverse rotation without redirection of external fluid lines and with or without reversal in direction of fluid flow.

In exploring the field of available fluid power devices used primarily in high pressure applications for industrial, agricultural, and construction industries, it has not been possible to find a design which meets all of the above criteria which would be suitable for an automotive application for regenerative braking and acceleration. Because the energy storage device for the regenerative system is an accumulator with a piston acting on compressed nitrogen, it is not possible to control the operating pressure in and out of the accumulator. Therefore, to modulate braking and acceleration forces, a variable displacement pump/motor is used to accomplish a driver controllable torque level from the near constant pressure regenerative storage device.

Currently, the highest efficiency commercially available variable displacement hydraulic devices are bent shaft and wobble plate axial piston units which are relatively massive and expensive to manufacture. To meet the compact packaging criteria above, it is felt that a new design light weight high efficiency hydraulic vane pump/motor is desirable having high pressure capability.

SUMMARY OF THE INVENTION

This invention is a reversible variable displacement hydraulic dual-pressure compensated roller tipped vane pump and motor featuring a variable depth vane slot with tailored outer ring contour having over-center stroke adjustment. The unique features of the design are listed below:

Balanced pressure compensation in both pump and motor mode by utilizing a pressurized end plate with two compensation areas to apply clamping forces proportional to the two operating pressures (inlet and outlet), thus compensating for the internal separating forces.

Further fine tuning of the pressure balance by adding communication passages between the variable pressure portion of the swept volume and small compensation pistons which adjust the clamping force to the variable separating force based on the angular position of the rotor. With small numbers of vanes, five or seven for example, the separating force varies, and therefore the required clamping force must adjust, by more than 15% based on the position of the vane as it moves through the pressure transition areas.

Ports in each of the end plates communicate with the swept volume of the vanes (outer ports) as they pass through segments 1 and 3. As a result of the vanes sweeping through the increasing and decreasing radial spaces, fluid flow is generated, which flow if resisted causes a pressure increase. This is the primary flow generating action of the pump, with the resulting flow passing through the outer ports.

There are additional ports (inner ports) which communicate with the inner extremity of the vane slots in all 4 segments. By having individual ports at the inner extremity of the vane slots in segments 1 and 3, it is possible to use the radial motion of the vanes in the slots as piston pumps to add significantly to the primary pumping action. Therefore, in both segments 1 and 3, the inner and outer ports are connected to each other. However, in segments 2 and 4 where there are no outer ports, there is maximum pressure unbalance on the vane and there can be minor amounts of radial motion depending on the ring configuration and displacement setting. Here, inner ports are required, fed by shuttle valves which supply the higher of the two pressures from segments 1 and 3, to insure good vane contact with the outer ring, thus minimizing fluid leakage across the side loaded vane.

The vane slots are stepped to extend into the integral shaft and rotor in the shape of a "T", with a deep excursion in the center and shallow portions on each side for each of the radial or angled slots between the two end plates. The 'T' shape of the vane and slots allows for maximum radial dimension of the vane in the deep excursion area to support the vane in all positions of extension. The shallow portions of the rotor slot add structure to the rotor body, stiffening the rotor and thus decreasing its deflection under the cantilever loading of the vanes as they are side loaded by the pressure differential.

A corresponding inner contour of the vane allows it to clear the stiffened rotor, thus allowing a long vane stroke for a given rotor diameter. This results in increased fluid displacement for a given package size while distributing the load transfer from the integral shaft to the rotor to the vane to the fluid with minimum distortion and stress concentration. In hydraulic devices, both friction losses and fluid leakage increase as the third power of the linear dimension, so that decreases in package size (diameter) have very significant improvements in operating efficiencies.

A hydrodynamically supported roller bearing is located at the tip of each vane parallel to the axis of rotation to minimize friction by building a film of oil to keep the roller supported in its pocket.

Vanes can be spring loaded radially outward to enhance low speed operation when centrifugal force is minimum.

Radial lightening holes can reduce vane mass to decrease speed bias holes are filled with plastic to reduce losses caused by fluid compression in the clearance volume.

Slots can be slanted to minimize radial sliding friction in the preferred direction of rotation as the vanes move radially in and out under load.

Full over-center stroke adjustment of the pivoting outer ring is controlled by a stepping motor and a lead screw or equivalent to accommodate transition from pumping mode to motoring mode without requiring a four way valve to reverse the external pressure connections.

Because the unit has the capability to operate both as a pump and as a motor, and is reversible in direction of rotation, and is variable in displacement, the outer ring which controls vane travel can be adjusted in its position relative to the rotor and housing. The further off center the ring is adjusted from the center of the rotor, the greater the fluid displacement for one revolution of the rotor. By adjusting the ring from one extreme position past center to the opposite extreme position, feed ports are essentially reversed in their function, so that, for a given direction of rotation and a given fluid connection, the unit operation switches from a fluid pump to a fluid motor or vice versa. As an example, port A, connected to a lower pressure source, communicates with an increasing volume inlet segment during pumping mode and a decreasing volume discharge segment during motoring mode.

Likewise, port B, connected to a higher pressure, communicates with a decreasing volume outlet segment during pumping mode and an increasing volume inlet segment during motoring mode. When direction of rotation reverses, for pumping mode, port A becomes the high pressure discharge port, and port B becomes the lower pressure inlet port.

The outer ring has four segments which approximate four quadrants. The contour of the outer ring controls the vane motion, so it is important that its configuration be tailored when possible to the expected job and duty cycle under which it will operate. The contour can be optimized for one operating mode, and still accommodate the other modes at slightly reduced efficiency as will be described subsequently.

If the unit operates primarily as a pump at its maximum displacement with a given direction of rotation, then the outer ring can be configured to favor these conditions. In the configuration for this example, segment 1 is increasing radius (vane moving outward), segment 2 is constant radius (vane fully extended but not moving radially), segment 3 is decreasing radius (vane moving inward), and segment 4 is decreasing radius for the first half of the segment and increasing radius for the latter half of the segment. A second option allows for segment 4 to be constant radius in this preferred operating mode where it is operating as a pump at maximum displacement. If it is desired to have the direction of flow reverse as the direction of rotation reverses, then nothing changes in terms of outer ring position. As direction of flow reverses, inlet (suction) and outlet (pressure) ports also interchange with each other.

In the opposite extreme position of the outer ring required for motoring mode forward rotation, segment 1 is decreasing radius (vane moving inward), segment 2 is decreasing radius for the first half of the segment and increasing radius for the latter half of the segment, segment 3 is increasing radius (vane moving outward) and segment 4 is constant radius (vane fully extended but not moving radially).

With the second option above where segment 4 was constant radius in the pumping mode, segment 4 is now decreasing radius for the first half of the segment and increasing radius for the latter half of the segment. The choice of the two options will be based on the customer application such as whether or not the motoring is important, thus optimizing the contour to fit the highest priority duty cycle usage.

As the rotor turns, all of the pressure unbalance on any given vane is during the portion of the time when it passes through segments 2 and 4. In the full displacement position, pumping, the vane is fully extended in segment 2 and fully retracted in segment 4. Therefore, friction losses are minimized in both maximum displacement settings because there is little or no radial vane movement when the vane is highly side loaded. For volume settings less than the maximum, there is a small amount of inward movement during the first half of the segment 2 in pumping m ode and segment 4 in motoring mode, and outward movement during the second half of the same segments. With this in mind, port openings in segments 1 and 3 can be positioned to allow controlled pressure increase or decrease as the contained fluid moves from low pressure to high pressure or vice versa as it moves across segments 2 and 4.

Rotor slot distortions can be predicted from the vane force and pressure distributions. To avoid binding a vane, additional clearance may be required, primarily at the outer diameter. This means that it may be desirable to taper the slot, in the order of 0.10 (6') to accommodate rotor and vane deflections without binding the vane in the slot.

Looking at the pressure gradient around th e circumference of the outer ring for the preferred direction n of rotation, there are two segments of approximately 720 duration (5 vane design) in both pumping mode and motoring mode where virtually all of the pressure differentials occur between fluid inlet and outlet. By concentrating on these two critical areas to control end clearance between the rotor and vane with the end plates, the end plates can be relieved in the noncritical areas. The leakage can be controlled without increasing the friction as much as would be experienced by tightly clamping the entire circumference.

These "pinch" segment plateaus in either the parent material or low friction laminate an be accomplished by a number of methods such as spraying, masking and dipping, or plating, or by removing metal in the non critical segments by mechanical or chemical machining.

Minimum restriction of fluid flow is accomplished by utilizing large and uniform passages from the external fluid fittings through the hub, seal ring junctions, the connecting outer ports in the end plate, and to the vane-swept cavities and the inner ports. If there is a preferred direction of rotation in the pumping mode, then the size of the inlet (suction) passages can be favored over the size of the outlet (pressure) passages.

Using the pump/motor as a regenerative braking device attached to the transmission of an automotive vehicle, it is anticipated that most or all of the use will be in the forward direction of rotation. The dual area pressure compensation allows for a reversal of pressures between pumping and motoring. However, in the application of the device as a pump for a four wheel drive assist, there could be considerable need for operation in the reverse direction of rotation with subsequent reversal of flow. (This synchronizes direction of rotation between front and rear wheels.) The dual area pressure compensation on the pressure plate allows for this reversal of pressure and suction ports. Friction in the reverse rotation mode will be equal to forward rotation if the rotor slots are radial. If the slots are canted, there is a slight increase in sliding friction in reverse rotation, and sliding velocities of the vane to rotor increase in both directions of rotation. This increase in friction with canted slots can result in minor decreases in efficiency in reverse rotation operation, but offset by an increase in efficiency in the total forward rotating regenerative operation, in both pumping and motoring modes, and in the forward rotation mode of the four-wheel drive assist.

BRIEF DESCRIPTION OF THE DRAWINGS

FIG. 8 is a partial cross-section side elevational view of a rotor;

FIG. 9*a* is an axial cross-section of the rotor of FIG. 8 taken along section line 9—9 of FIG. 8;

FIG. 9*b*, 9*c*, and 9*d* illustrate alternative rotor cross-sections which otherwise correspond to FIG. 9*a* having various slot orientations;

FIG. 10 is a radial view of a fragment of the rotor taken along section line 10—10 of FIG. 8;

FIG. 11 is a side elevational view of a T-shaped vane body;

FIG. 12 is right side elevational view of the vane of FIG. 11;

FIG. 13 is a bottom plan view of the vane of FIG. 11;

FIG. 14 is a roller adapted to cooperate with the vane body of FIG. 11;

FIG. 15 is an axial end view of the roller of FIG. 14;

DETAILED DESCRIPTION OF THE PREFERRED EMBODIMENT(S)

Figure 1:
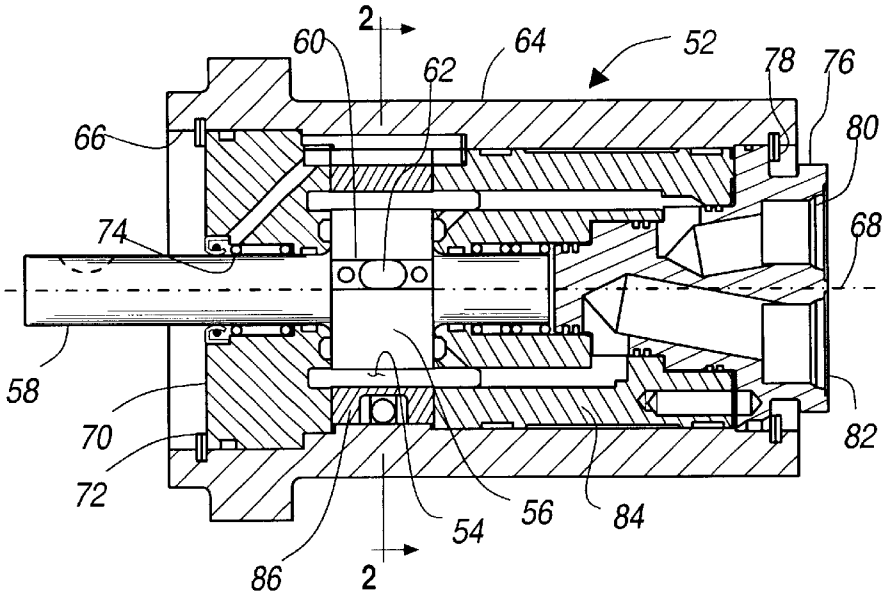
FIG. 1 is cross-sectional side elevational view of the preferred embodiment of the variable displacement hydraulic vane pump/motor.
Figure 2:
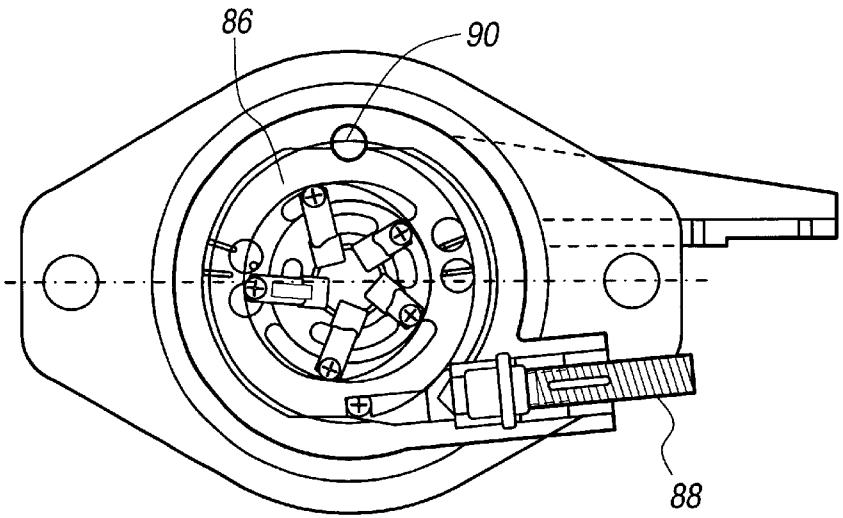
FIG. 2 is a cross-sectional end view taken along line 2—2 of FIG. 1.

FIGS. 1 and 2 illustrate a preferred embodiment of hydraulic vane pump/motor 50 which incorporates the various novel features of the present invention. Vane pump/motor 50 can be used as a hydraulic motor or alternatively, a hydraulic pump. Of course, in certain applications, the unit can be used as a dedicated pump or dedicated motor. Accordingly, the term "vane pump", "vane motor" or "vane pump/motor" may be used throughout this application irrespective of the specific dedicated application, to which the unit may be ultimately put. Vane pump/motor 50 as shown in side elevational view in FIG. 1, is made up of a body assembly 52 which defines an internal cavity 54. Oriented within internal cavity 54 is a generally cylindrically shaped rotor 56 provided with an output shaft 58 which extends axially through one end of body assembly 52. Rotor 56 is provided with a plurality of slots which extend axially along the inner space about the cylindrical periphery of the rotor. In the embodiment illustrated in body slot 60 are evenly spaced about the rotor periphery as illustrated in FIG. 2. Oriented within each slot 60 is a vane 62 which is free to move within a limited radial range slot 60. The vane is provided with a distal end inserted into the slot and a proximate end which extends radially outward and cooperates with internal cavity 54 formed within the body assembly 52 specifically described more fully below.

The body assembly is provided with a fluid inlet port and fluid outlet port in communication with the internal cavity. The internal cavity 54 has a plurality of zones which include at least two spaced apart segments having a circumferentially varying radius, each of which is provided with a fluid port. At least two transition regions are interposed between the circumferentially varying radius segments and have an internal cavity radius is relatively constant. The plurality of vanes bisect the internal cavity into a series of variable displacement chambers. Rotation of the rotor relative to the housing causes these chambers to sequentially increase and decrease in size, causing fluid to flow in one of the fluid ports and out the other.

Body assembly 52 of the pump of the preferred embodiment is made up of a number of sub-components. Body assembly 52 includes a tubular body 64 having a stepped cylindrical bore 66 oriented along the central axis 68. A first end plate 70 is installed in cylindrical bore 66 and is held in a fixed position against a step in the bore by a retainer ring 72. The first end plate 70 forms one side wall of internal cavity 54 and end plate 70 is further provided with a central bore 74 through which output shaft 58 extends. A second end plate 76 is affixed in the opposite end of tubular body 64 and is likewise securely held in place against a step in the cylindrical bore by a retainer ringer 78 and is prevented from moving axially or rotationally relative to tubular body 64. Second end plate 76 is provided with first and second inlet outlet ports 80 and 82. Second end plate 76 may alternatively be referred to as a manifold.

Interposed between the first and second end plates within the cylindrical bore 66 is a pressure plate 84 which forms a second side wall of the internal cavity 54. Pressure plate 84 is prevented from rotating relative to the tubular body 64 of the housing, but is able to move axially through a limited range toward and away from the internal cavity 54. In the preferred embodiment illustrated, the outer wall which forms the internal cavity, rather than being machined on the inner periphery of the tubular body 64, is formed as the discrete chamber ring 86. Forming chamber ring 86 as a separate element, eases the manufacturing and provides a removable part for service and enables the chamber ring to be shifted laterally relative to the housing central axis in order to vary pump displacement.

In the embodiment illustrated, chamber ring 86 may be shifted relative to the housing by an adjuster mechanism 88 illustrated in FIG. 2. The upper tangential edge of chamber ring 86 is pivotally affixed to the tubular body formed by pivot pin 90. Chamber ring adjuster 88 cooperates with the diametrically opposite edge of the chamber ring enabling the chamber ring to be shifted to the right or the left as illustrated in FIG. 2. When the chamber ring axis is concentric with the central axis 68 of the pump the pump has zero displacement. By enabling the chamber ring 86 to be shifted both to the left, to the right and to center. The motor pump unit can be shifted between the motor mode and the pump mode without changing the direction or rotation of the rotor. Chamber ring adjuster 88 is made up of a threaded screw which cooperates with a nut insert retained in a boss in the tubular body as illustrated. The screw is rotated by a reversible motor not shown.

Figure 3:
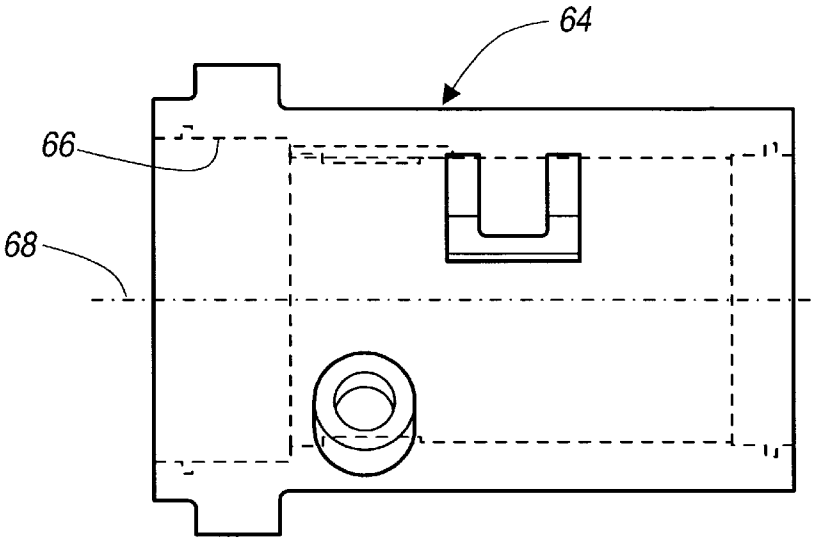
FIG. 3 is a side elevational view of the motor housing tubular body portion.
Figure 4:
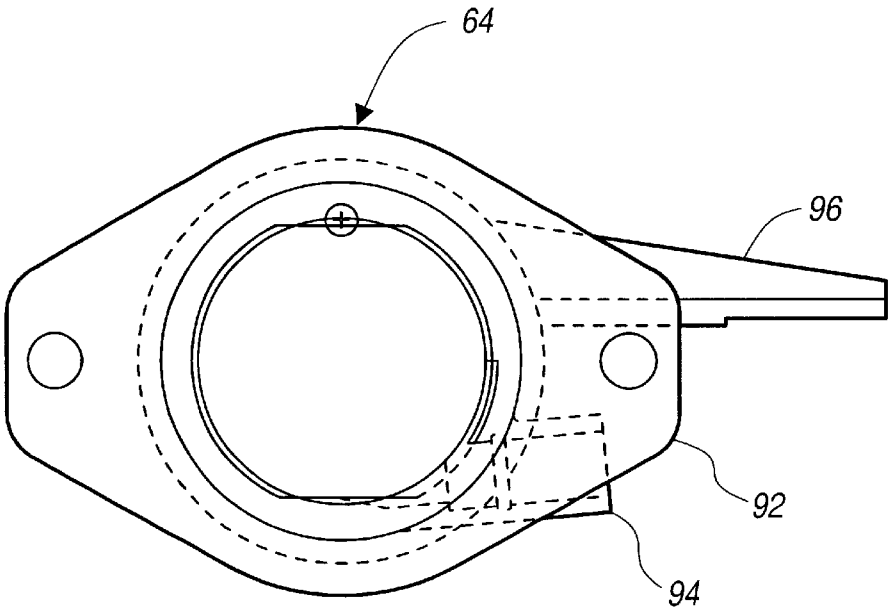
FIG. 4 is an axial end view of the motor housing tubular body portion.

A more detailed view of the tubular body 64 is shown in FIGS. 3 and 4. The tubular body 64 is further provided with a mounting flange 92 which may take on various shapes depending upon the application. Body 64 is further provided with a tubular boss 94 for the chamber ring adjuster 88 and an arm 96 for supporting the chamber ring adjuster motor is not shown.

Figure 5:
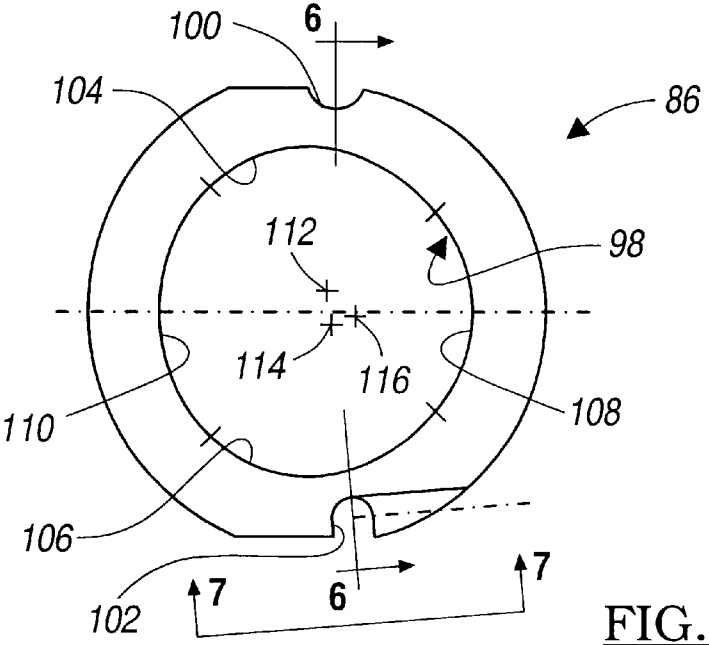
FIG. 5 is an axial end view of the chamber ring.
Figure 7:
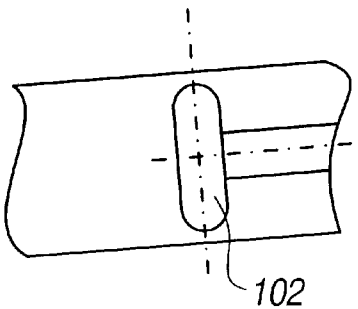
FIG. 7 is a radial view of the chamber ring taken along line 7—7 of FIG. 5.
Figure 6:
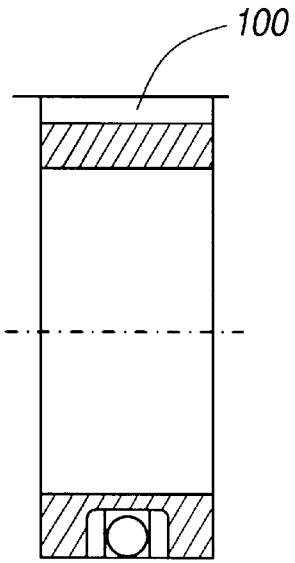
FIG. 6 is a cross-sectional side elevation of the chamber ring taken along section line 6—6.

A detailed view of chamber ring 86 is provided in FIGS. 5–7. Chamber ring 86 is a generally annular shape having a central bore which extends therethrough having a precise inner peripheral wall 98 having a precise geometry. Inner wall 98 of chamber ring 86 forms the outer wall of internal cavity 54 and the ends cooperate with the vanes as the rotor rotates within the internal cavity. The outer periphery of chamber ring 86 is provided with a notch 100 at the upper edge illustrates in FIGS. 5, 6, for cooperation with the pivot pin mounted on the tubular body 64 to facilitate chamber ring adjustment. Generally, diametrically opposite notch 100 is a T-shaped notch 102. As illustrated in notch in FIG. 7, notch 102 cooperates with the distal end of a chamber ring adjuster 88. In order to shift the chamber ring relative to the housing central axis to vary pump displacement and change between the motor and pump modes.

Inner peripheral wall 98 of the chamber ring 86 is carefully machined into four segments. Segment 104 has a radius relative to the pump central axis 68, which when the pump is in the active mode (non-zero displacement) varies circumferentially. Segment 106 likewise has a circumferential varying radius relative to the housing central axis. Segments 108 and 110 which are respectively oriented between segments 104 and 106 as illustrated, have a relatively constant radius relative to the central axis. Preferably, each of the four segments of chamber ring inner wall 104, 106, 108, 110, are each machined with a constant diameter. The locus of the radii defining the surface of segment 104 is illustrated at point 112. The locus of the radii formula the surface of segment 106 is illustrated at point 114 and the locus of two radii of different lengths which form segment 108 and segment 110 both fall at point 116. The locations of point 116 is selected to optimize pump performance at a particular operating displacement and mode. When point 116 is aligned with the housing central axis 68, there will be no radial movement of vanes 62 relative to the rotor slot 60 through segments 108 and 110, thereby minimizing friction. Point 116 will typically be located to correspond with the maximum pump displacement position of the chamber ring at either of the pump or motor mode, depending upon the preferred mode of operation of the unit. When machining the inner wall 98 of chamber ring 86, the intersections of the machine surfaces corresponding to the four radii will be blended appropriately to eliminate steps of shared corners.

Rotor 56 is shown in detail in FIGS. 8–10. Rotor 56 is made up a generally cylindrical body 112 having a circular outer periphery 114 and a pair of end faces 116 and 118. Output shaft 58 extends from at least end face of the rotor. In the preferred embodiment, stub shaft 120 extends from end face 118 of the rotor generally opposite of output shaft 58. Stub shaft 120 enables roller bearings to be located on both sides of the rotor to support the rotor securely within the internal cavity 54 and allows the rotor to be hydraulically balanced within the internal cavity.

The rotor 56 is provided with a series of slots 60 extending axially along the cylindrical periphery 114 of the rotor in an evenly spaced relation. The slot configuration illustrated in FIGS. 8 and 9*a* is quite unique. The depth of slots 60 varies along the axial length of the slot. As illustrated in FIG. 8 cross-section, the center slot being deeper and forming a recess pocket 120 (shown in radial view in FIG. 10). This slot shape allows the slot be very deep to achieve vane support without sacrificing structural integrity of the rotor, particularly in small rotor diameters. As illustrated in FIG. 9*a*, the preferred embodiment of the invention has canted slots, i.e. slots that are inclined relative to a pure radial line. The slots are canted in an angle which is between 10° and 20° from a pure radial orientation. Canting the slots in combination with the stepped slot profile enables the rotor diameter to be minimized and further minimizes pump friction in the preferred direction of rotation.

Alternative cross-section 9*b* illustrates a stepped slot having a radial orientation. FIG. 9*c* illustrates a radial slot of a non-stepped orientation. Note, slot depths are reduced substantially in order to maintain rotor structure. FIG. 9*d* illustrates a constant depth, canted slot design. While it is believed that the variable depth of canted slot design illustrated in FIG. 9*a* will provide optimum performance, the present invention can be practiced using any number of various rotor slot orientations and designs. Likewise, the preferred embodiment of the invention is described with reference to a five vane pump. Of course, a different number of vanes can likewise be utilized, depending upon the particular application and the cost and design constraints.

FIG. 11 is a front view of a vane body 122 used with the preferred T-shaped slot. Vane body 122 is generally T-shaped having an elongate head portion 124 and a central depending leg 126. Leg 126 is sized to telescopically fit within pocket 120 in slot 60. Head portion 124 likewise telescopically fits within slot 60 in the rotor. In the preferred embodiment, the head portion 124 of vane body 122 is provided with an elongate semi-cylindrical slot 128 designed to receive a cylindrical roller 130 therein. Roller 130 is illustrated in FIGS. 14 and 15 and is hydramatically supported within semi-cylindrical slot 128. The roller diameter about 0.8 times the vane thickness and must be larger than the adjacent ports. Roller 130 provides a relatively fluid type rolling joint between the vane body 122 and inner wall 98 of chamber ring 86. In order to maintain the vane and roller in contact with inner wall 98, a pair of springs not shown fit within spring pockets 132 illustrated in FIG. 13, on the inside of the vane body portion 124 for biasing the vane radially outward.

Figure 18:
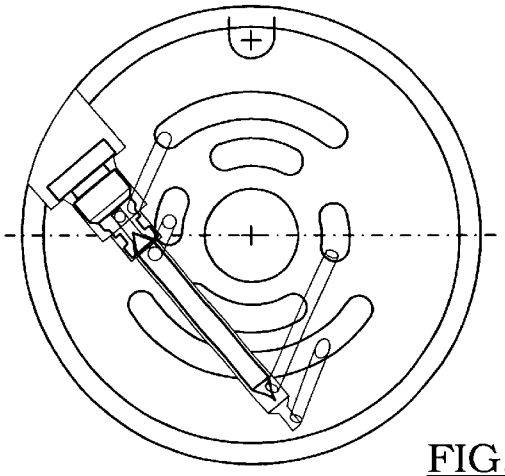
FIG. 18 is an alternate view of the right end face of FIG. 17 modified to illustrate the internal shuttle valve assembly and fluid passages formed therein.
Figure 17:
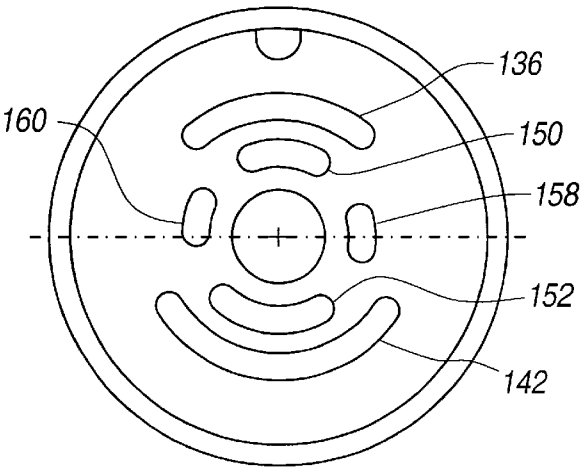
FIG. 17 is a right side view of the face of the end plate which cooperates with the rotor.
Figure 16:
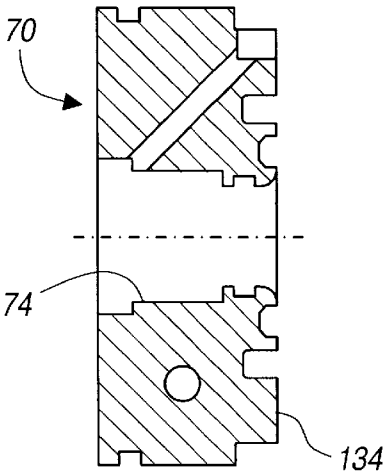
FIG. 16 is a cross-sectional side elevational view of the first end plate.

First end plate 70 is shown in detail in FIGS. 16–18. First end plate 70 as previously described, is a generally annular member sized to fit within the step cylindrical bore 66 of housing tubular body 64. On the axial center of the first end plate 70 is a bore 74 sized to accommodate output shaft 58. As illustrated in FIG. 1 cross-section, a bearing is interposed between bore 78 and the output shaft and a seal is provided outboard of the bearing to prevent hydraulic fluid loss. First end plate 70 is provided with an inner face 134 which extends perpendicular to the center axis and forms one of the side walls defining the internal cavity 54. As illustrated in FIG. 17, face 134 has a series of arcuate grooves machined therein which are a mirror image of the corresponding ports formed in the end of pressure plate 84 illustrated in FIG. 21. First groove 136 corresponds to first port 138 and face 140 of pressure plate 84. Second groove 142 corresponds to second port 144. As illustrated, preferably port 144 has a slightly greater arcuate extent than first port 138. Ideally, the larger port would be arranged so that in the normal mode of operation, the port would be exposed to all low pressure, i.e. an inlet during pump motion and an outlet during motor mode.

Figure 19:
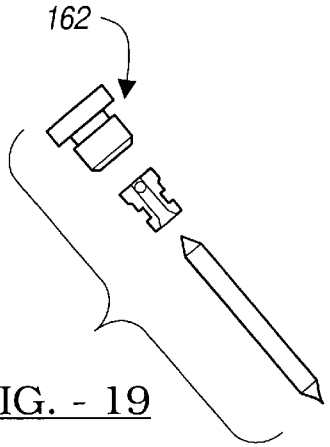
FIG. 19 is an exploded view of the shuttle valve assembly of FIG. 18.
Figure 21:
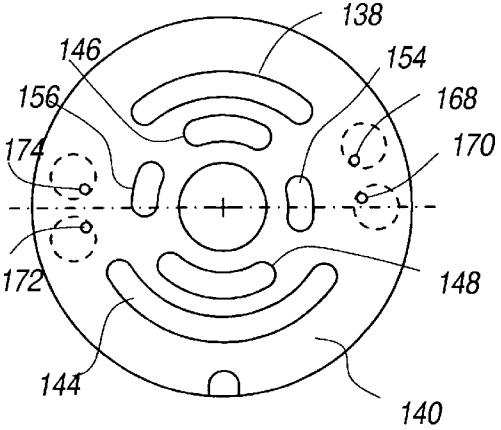
FIG. 21 is a left end view of the face of the pressure plate which cooperates with the rotor.
Figure 27:
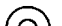
FIG. 27 is an axial end view of the port liner of FIG. 26.
Figure 26:
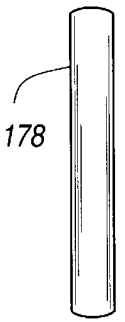
FIG. 26 is a side elevational view of a port liner.

Also machined in face 140 of the pressure plate and with a corresponding groove machined in face 134 of the first end plate are a series of inner ports; first inner port 146 and second inner port 148 which correspond to first inner arcuate groove 150 and a second inner arcuate groove 152. A pair of secondary inner ports 154 and 156 are provided between first and second inner ports 146 and 148 as illustrated in FIG. 21. A corresponding pair of secondary inner grooves 158 and 160 are likewise provided in mirror image of the ports in the pressure plate. During operation of the pump, as the vanes move within the slots, fluid will be drawn into and displaced from the region of the slot below the vane. The fluid entering the slots beneath the vane during the pumping mode will be introduced via second inner port 148 and will be discharged the first inner port 146. Secondary inner ports 154 and 156 communicate with the slots and the rotor when the vanes are in the transition zones. Preferably, the pressure of the hydraulic fluid within the secondary inner ports will be maintained at the higher of the two pressures of the fluids at the first and second ports 138 and 142. This is achieved by shuttle valve assembly 162 shown in exploded view of FIG. 19. Shuttle valve assembly fits within a machine pocket and the first end plate is provided with a series of passages interconnecting groove 136 which corresponds to the first port 138 and groove 142 which corresponds to second port 144. The shuttle valve selects the higher of the two pressures and communicates that pressure to both of the secondary inner ports via secondary inner grooves 158 and 160. By maintaining the higher of the two fluid pressures beneath the vanes while in the transition zones, the roller tip 130 of the vane will be maintained in constant contact with inner wall 98 of the chamber ring.

Pressure plate 84 is shown in detail in FIGS. 20–27. It is best shown in cross-sectional view in FIG. 20; inner ports 146 and 148 are connected to first and second ports 138 and 144 by a diagonal passageway illustrated. Therefore, in operation, the pump acts as both a vane pump as the regions between adjacent vanes which vary in displacement forcing liquid into and out of the first and second ports, as well as a piston pump as the vanes translate generally radially within their associated slots, displacing fluid into and out of first and second inner ports 146 and 148.

One of the novel features of the present invention is that pressure plate 84 is hydraulically balanced to maintain a desired axial load on the rotor which varies as a function of the gross pressures in the first and second port as well as cyclically varying forces within each rotation to compensate for the ever changing high and low pressure areas as the vanes move relative to the first and second ports. The gross pressure adjustment is achieved by two pressure compensation zones. The first compensation zone is formed between step 164 in the pressure plate on the corresponding on the second end plate 76. A second compensation zone is formed by step 166 on the pressure plate which corresponds with a similar surface on the second end plate. The first compensation zone is in communication with a first port 138 and the second compensation zone is in fluid communication with the second port 144. Whatever the pressure is on the first and second ports, tending to push the pressure point away from the rotor, an appropriately balanced reaction force will be exerted on the pressure plate by the first and second compensation zones to maintain the proper load and corresponding clearance between the pressure plate and rotor throughout the range of operating conditions.

Figure 22:
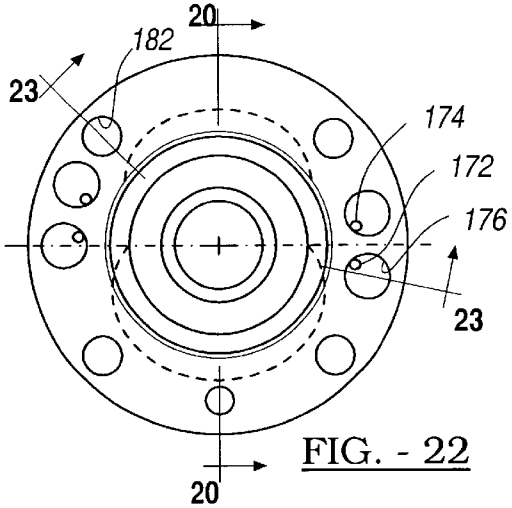
FIG. 22 is a left end view of the pressure plate shown in FIG. 20. Section line 20—20 through 22 corresponds to the cross-section illustrated in FIG. 20.
Figure 23:
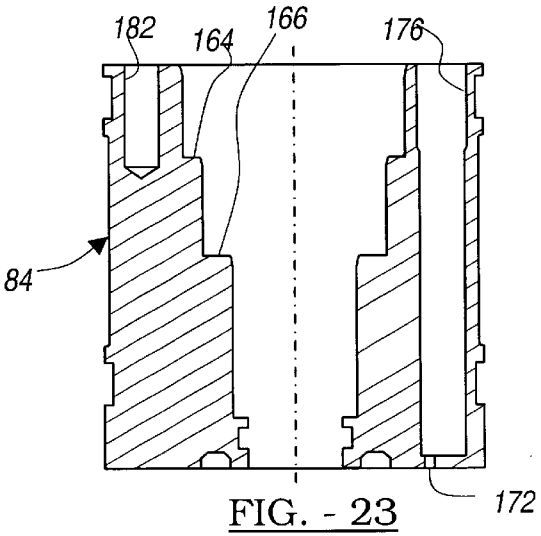
FIG. 23 is a cross-sectional view of the pressure plate taken along section line 23—23 in FIG. 22.
Figure 20:
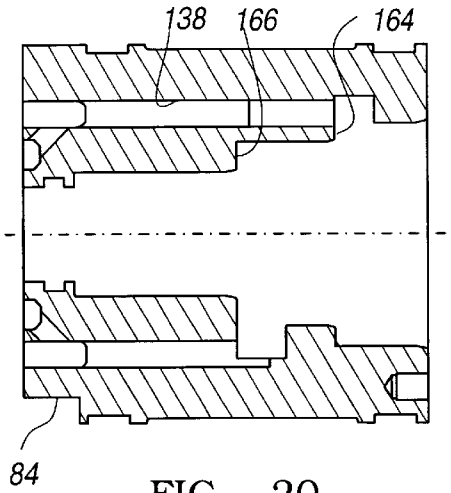
FIG. 20 is a cross-section side elevational view of the pressure plate.
Figure 25:
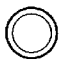
FIG. 25 is an end view of the micro balance piston of FIG. 24.
Figure 24:
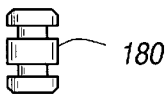
FIG. 24 is a side elevation of the micro balance piston.
Figure 32A:
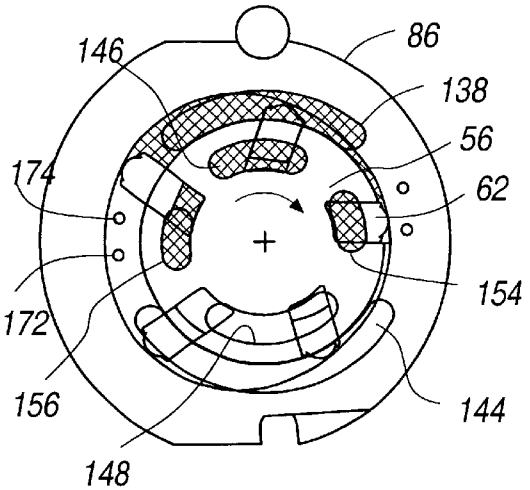
FIG. 30*a*, 31*a* and 32*a* are a series of sequential illustrations showing the high and lower pressure zones as the rotor rotates clockwise.
Figure 32B:
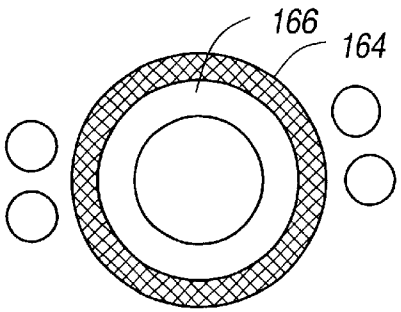
FIGS. 30*b*, 31*b* and 32*b* schematically illustrate the variation in high and low pressure compensation forces in the pressure compensation regions as a result of the rotor rotation.
Figure 31A:
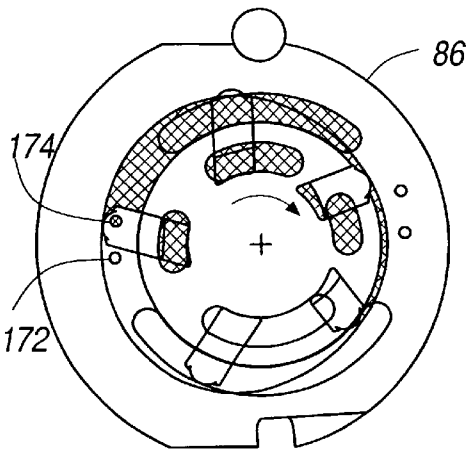
Figure 31B:
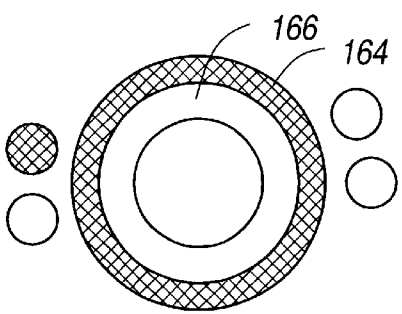

As noted earlier, minor cycle to cycle axial loads are exerted on the pressure plate as the vanes move relative to the first and second ports; this effect, which was described subsequently with reference to FIGS. 32*a*, 32*b*. To achieve micro balance, four micro ports are formed in face 140, 168, 170, 172 and 174. These small diameter ports communicate with a corresponding larger passage as shown in FIG. 23 cross-section as passage 176. This passage is a large diameter for machining purposes and subsequently filled with a passage liner 178 shown in FIGS. 26 and 27 which uses the liquid volume in the passage making the fully common hydraulically stiffer. A piston 180 shown in FIGS. 24 and 25 is installed in passage 176, fluid pressure and the micro port causes the piston 180 to act upon the second end plate urging the pressure plate toward the rotor. Four such passages and pistons are provided as illustrated in FIG. 22 and is further described subsequently. In addition to the hydraulic forces urging pressure plate 184 toward the rotor, a series of spring pockets 182 are formed in the pressure plate 184 as illustrated, provided with a spring (not shown) for urging the pressure plate into contact with the rotor independent of hydraulic pressure.

Figure 29:
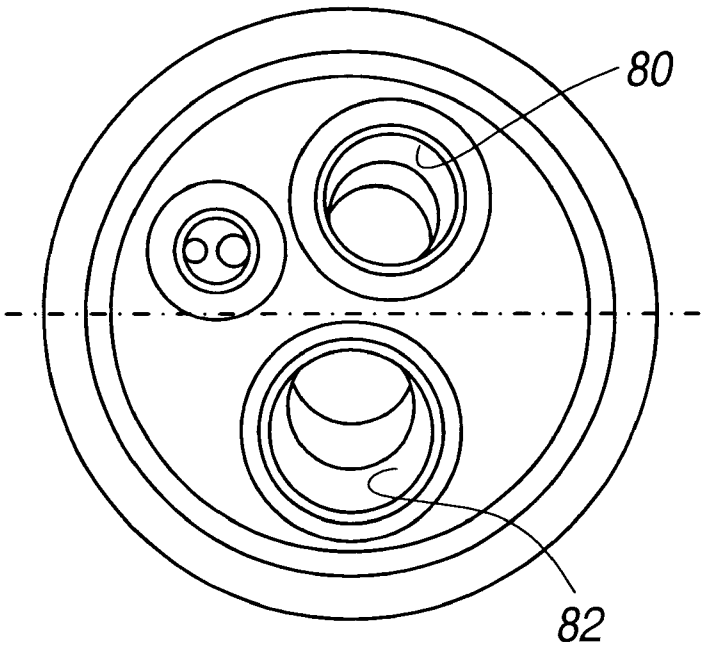
FIG. 29 is a right side elevational view of the second end plate of FIG. 28.
Figure 28:
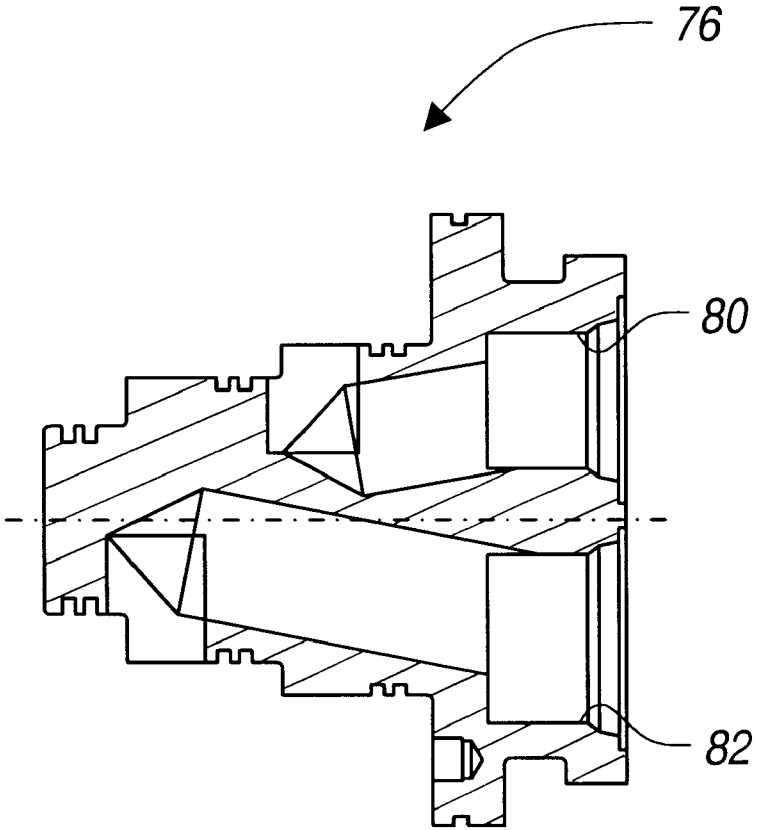
FIG. 28 is a cross-section side elevational view of the second end plate.

FIGS. 28 and 29 illustrate the second end plate 76, cross-sectional side view and end view, respectively. First inlet/outlet port 80 communicates with the first port 138 and the pressure plate, while second inlet/outlet port 82 communicates with the second inlet/outlet port 144 in the pressure plate 84. The second end plate 76 is fixed relative to tubular housing 84. Pressure plate 84 is pinned by a pin not shown which fits within the pin pockets illustrated, so that the pressure plate is restrained from rotating, but is free to move axially through a limited range.

Figure 30A:
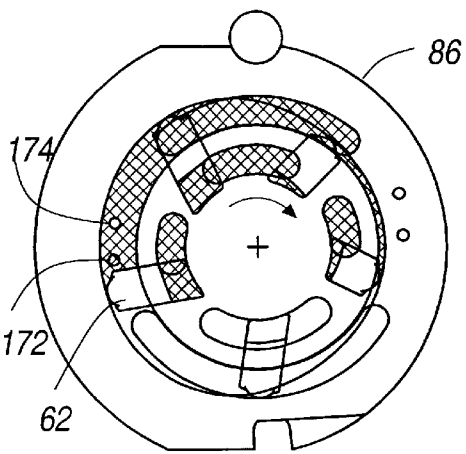
Figure 30B:
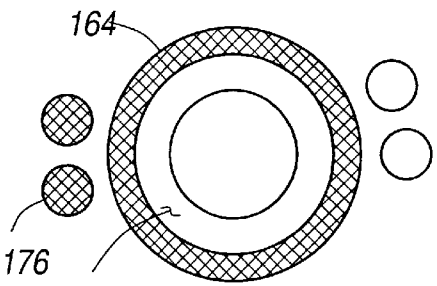

FIGS. 30*a* through 32*a* illustrate schematically the rotor rotating relative to the chamber ring when the motor pump is operated in the pumping mode and the rotor is turning clockwise. The cross hatched areas represent high pressure as can be seen from comparing FIG. 30*a* to FIG. 31*a* to FIG. 32*a*, the area of the high pressure zones vary as the rotor rotates. Further rotation of the rotor from the position illustrated in 32*a* causes the vane oriented at the 10:00 position to pass the first port causing the high pressure to once again be maximized as shown in FIG. 30*a*. In order to compensate for this micro variation and axial load on the pressure plate as the rotor rotates, micro ports described previously act upon a series of pistons 180. FIGS. 30 through 33 illustrate three possible micro four pressurization schemes. Two ports are pressurized in FIG. 30*b*, one port is pressurized in FIG. 31*b* and no micro ports pressurized in FIG. 32*b*. Note that only two micro balance ports are active when the chamber ring is in the position illustrated. When the chamber ring rotates to the opposite travel, the other two micro ports will be active. It is believed that only four micro ports are necessary to achieve a reasonable degree of balance. Of course, fewer i.e. two or more, six or eight micro ports could be provided if dictated by space or cost considerations.

Figure 35:
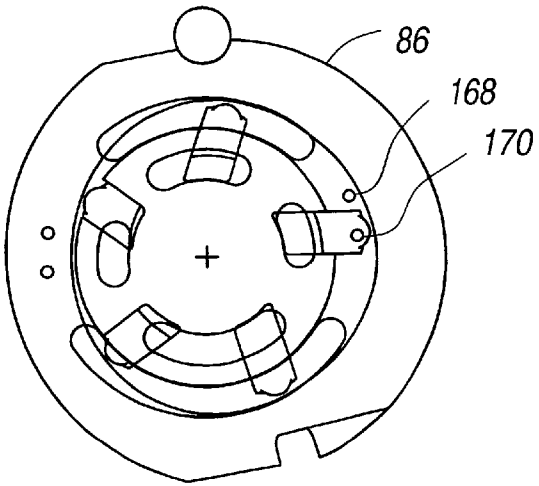
FIGS. 33, 34 and 35 are a series of views showing movement of the chamber ring in the shifted left position, the neutral position and shifted right position, respectively.
Figure 34:
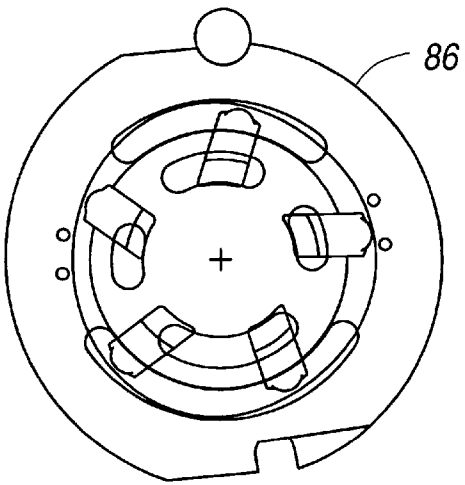
Figure 33:
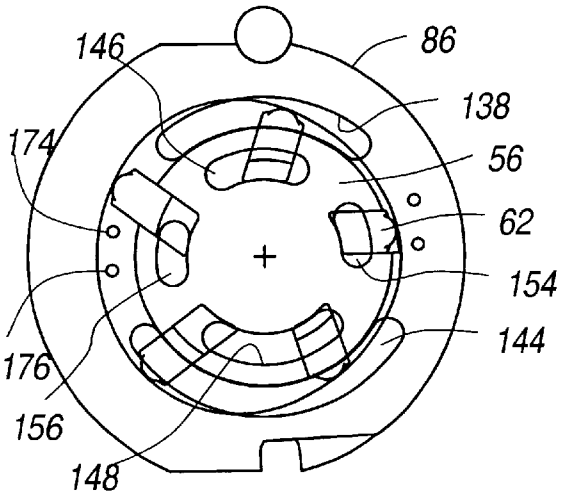

As previously described, the chamber ring 86 can be moved by a chambering actuator 88 from a central neutral position to the maximum displacement position on either side of neutral. These three positions are shown in FIGS. 33, 34 and 35. FIG. 33 is chamber ring shifted to the left of the maximum amount. FIG. 34 is a chamber ring in the neutral position and FIG. 35 has the chamber ring shifted to the right, the maximum amount. In FIG. 33 orientation, we have maximum displacement with the motor pump operating the pumping mode with clockwise rotation. Similarly, the unit when in the configuration shown in FIG. 33 could be in the pumping mode reverse rotation reverse flow, motor mode, reverse rotation, reverse flow or motor mode, forward rotation with reverse pressure connections.

Of course, in the neutral position shown in FIG. 34, the pump has zero displacement and there is accordingly, zero flow. In FIG. 35, orientation of the chamber ring with forward rotation in the pumping mode, we will have reverse flow. With reverse rotation in the pumping mode, there will be forward flow. When motoring in the forward rotation, there will be reverse flow and when motoring in the reverse direction, pressure connections will reverse.

The hydraulic motor pump of the present invention is therefore very versatile and can be operated as a motor or as a pump in either direction of rotation by simply moving the chamber ring. The axial load on the pressure plate will automatically adjust throughout all the varying operating conditions to maintain the proper load on the piston and maintain proper clearance between the pressure plate face and the router side wall.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A hydraulic vane pump/motor comprising:

a housing assembly aligned along the central axis defining an internal cavity having a pair of spaced apart side walls perpendicular to the central axis and outer wall having a radial distance from the central axis which varies circumferentially in at least two spaced apart segments of the internal cavity, the internal cavity in the region of each of the at least two spaced apart segments having a circumferentially varying radius being provided with a fluid port formed in the housing;

a generally cylindrically shaped rotor sized to fit within the internal cavity in the housing for rotation about the central axis, a rotor having an integral output shaft which extends axially through one of the walls in the housing assembly and a plurality of axially extending slots spaced about the cylindrical periphery of the rotor, each of the axially extending peripheral slots having a relatively deep independent localized blind pocket centrally formed therein, the blind pockets extending generally inwardly toward but terminating short of the central axis at a point which is inboard of the outer shaft periphery in axial end view; and a plurality of vanes oriented within each of the slots, each vane having a generally T-shaped body sized to fit within the slot, the body having a head portion and a leg portion depending therefrom, the head portion having an axial length generally corresponding to the axial length of the rotor and a radial length which is greater than the maximum travel of the vane, the leg portion extending into the central pocket in the rotor slot, the leg portion and the central pocket in the slot having an axial length which is substantially less than the axial length of the rotor, thereby providing improved resistance to vane side loading while maximizing rotor strength at smaller rotor diameters.

2. The hydraulic vane pump/motor of claim 1 wherein the vanes have a thickness X and the rollers have a diameter of about 0.8 times X.

3. The vane pump/motor of claim 1 wherein the slots formed of the rotor are canted from radial an angle 10° to 20°.

4. The vane pump/motor of claim 1 wherein each of the vanes is further provided with an axial elongated roller mounted on the distal end thereof within a semi-circular groove in the vane body with the roller forming a rolling fluid type seal with the outer wall of the housing internal cavity in order to reduce friction and extend the wear life of the vanes.

5. The hydraulic vane pump/motor of claim 1 wherein one of the spaced apart walls of the housing assembly is provided by a pressure plate which is axially shiftable toward and away from the internal cavity, wherein an axial end of the pressure plate spaced from the internal cavity is provided with a pair of annular pressure compensation regions, each in fluid communication with a different one of the fluid ports so that rotation of the rotor relative to the housing assembly causes fluid to be displaced from one port to the other, enabling the hydraulic vane pump/motor to be operated in the motor mode or the pump mode in either a clockwise or counter-clockwise direction through a range of operating pressures while automatically nominally balancing the axial loads of the pressure plate to maintain proper axial clearance therebetween.

* * * * *